United States Patent [19]

Moisdon

[11] Patent Number: 4,656,959

[45] Date of Patent: Apr. 14, 1987

[54] VERTICAL SHIP

[76] Inventor: Roger F. G. Moisdon, 4875 SW. 28th Ave., Ft. Lauderdale, Fla. 33312

[21] Appl. No.: 715,726

[22] Filed: Mar. 25, 1985

[51] Int. Cl.[4] ..... B63B 1/32

[52] U.S. Cl. ..... 114/56; 114/59; 114/264; 114/330

[58] Field of Search ..... 114/56, 59, 256, 259, 114/264, 265, 222, 330, 331, 332; 405/195, 196, 200, 201, 202, 203, 205, 206

[56] References Cited

U.S. PATENT DOCUMENTS

| | | | |
|---|---|---|---|
| 1,690,547 | 11/1928 | Myers | 114/259 |
| 2,319,855 | 5/1943 | Forsberg | 114/259 |
| 2,998,790 | 9/1961 | Mason | 114/265 |
| 3,413,946 | 12/1968 | Von Schultz | 114/264 |
| 3,709,184 | 1/1973 | Laney | 114/222 |
| 3,830,178 | 8/1974 | Lang | 114/61 |
| 4,054,104 | 10/1977 | Haselton | 114/264 |
| 4,231,681 | 11/1980 | Tuson | 405/195 |

FOREIGN PATENT DOCUMENTS

| | | | |
|---|---|---|---|
| 1334342 | 10/1973 | United Kingdom | 405/195 |

*Primary Examiner*—Joseph F. Peters, Jr.
*Assistant Examiner*—Thomas J. Brahan
*Attorney, Agent, or Firm*—Alvin S. Blum

[57] ABSTRACT

There is disclosed herein a vertical ship utilizing the buoyancy principles of a submarine. The vertical watercraft is fluid-dynamically streamlined in the direction of travel and has an elongate, pipe-like hull. The elongate, normally vertical hull is provided with ballast means by which the height of a pilot house on the top of the pipe-like hull may thereby be lifted or lowered. Also, the ballast means permit changes in attitude of the hull relative to the gravity vector. The vertical watercraft may be provided with numerous energy recovery means and, as well, may be used as a mining and cargo vessel.

22 Claims, 12 Drawing Figures

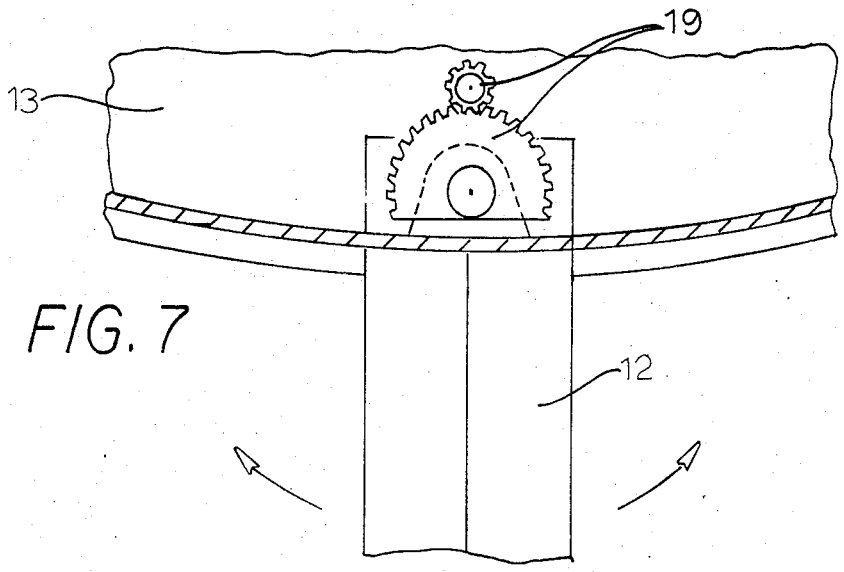
FIG. 7
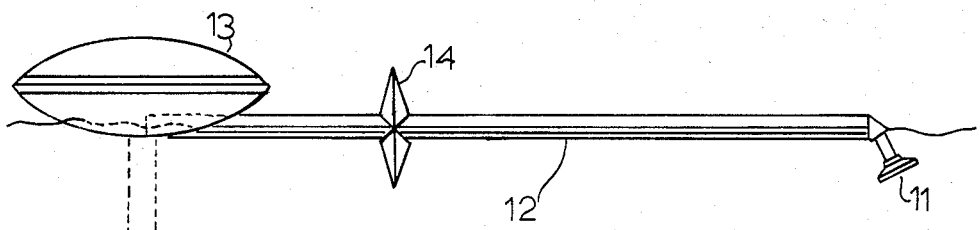
FIG. 8
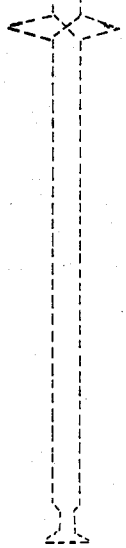
FIG. 9
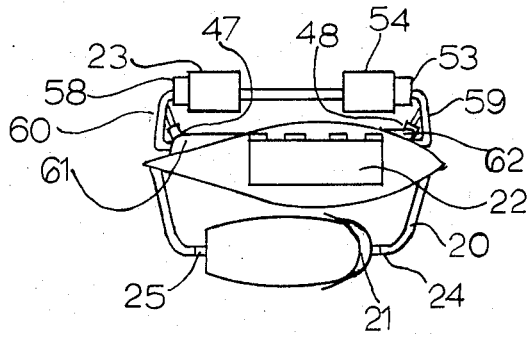

VERTICAL SHIP

BACKGROUND OF THE INVENTION

The present invention relates generally to watercrafts and, more particularly, to a novel watercraft termed herein a "vertical ship".

At the present time, water travel constitutes the largest means of surface conveyance of people and cargo around the world. They are subject, in their reliability, to surface conditions of the seas and the risks related thereto. Numerous difficulties and deficiencies are associated with travel upon the surface of the ocean.

It has become well known that only a small layer of the body of the ocean is disturbed by the surface waves. The largest part of the ocean body, which is situated directly underneath the wave layer, is very stable. Surface boats, by their very character, make use only of the disturbed portion of the ocean and, consequently, are jarred up and down according to the level, position, and pitch of the waves.

The herein proposed vertical ship makes use only of the stable lower part of the ocean, including its buoyancy, which remains unaffected by the waves at the surface.

The vertical ship, in addition to its enhanced stability is capable of affording other advantages, these including, recovery of wave energy, capability of anchoring without chains, reduced consequences of collision, reduced seasickness, greater comfort to passengers and crew, capability of containing a shuttle or amphibious vehicle, serving as a deep diving station, serving as a disaster-proof vehicle in research situations, providing a pilot house having a 360° unobstructed view of the horizon, capability of landing in shallow shores, ability to work under the ocean, special cargo handling capability, recovery of natural sources of energy and, as a result of much of the foregoing, reduced accident insurance premiums and reduced harbor use fees.

The present invention is believed to be properly classified in U.S. Class 114, Subclass 140.

SUMMARY OF THE INVENTION

The present inventive vertical ship involves the usage of buoyancy techniques now limited exclusively to submarine technology. The vertical ship, whose net buoyancy is zero, comprises a fluid-dynamically streamlined horizontal cross-section having a elongate, vertical pipe-like overall configuration. Longitudinally disposed within the elongate pipe-like structure are means for controlling the buoyancy of the ship. Also, longitudinally disposed within the ship is a cargo area. The inventive vertical ship may additionally, be provided with a detachable pilot house, specialized anchoring means, and energy recovery means for using solar and wave energy. Additionally, the normal vertical attitude of the ship may be altered.

It is thusly an object of the present invention to provide a vertical ship that may be utilized as a deep-diving or, ocean floor mining, station.

It is a further object to provide a vertical ship that is particularly adapted to make use of solar energy, ocean wave energy, and ocean thermocline energy.

It is yet a further object to provide a substantially disaster-proof vessel.

It is a still further object to provide a ship capable of direct landing in any harbor or shore, regardless of how shallow the coastal area may be.

It is a still further object to provide a substantially submarine vehicle capable of carrying large quantities of cargo or ore.

It is yet a further object to provide a vertical ship having a pilot and passenger house situated on top of the superstructure of the vertical ship, such a pilot house having a 360° unobstructed view and being capable of lowering or raising its level relative to the ocean surface through employment of buoyancy altering means of the vertical longitudinal ballast means of the hull of the ship proper.

It is a still further object to provide a ship in which the passengers and crew will be separated from the noise, oder and vibrations of the ship's machinery.

The above and yet further objects and advantages of the present invention will become apparent in the hereinafter set forth Detailed Description of the Invention, the Drawings, and Claims appended herewith.

BRIEF DESCRIPTION OF THE DRAWINGS

FIG. 7 is a cross-sectional view taken along Line 7—7 of FIG. 1.

FIG. 8 is a perspective view of the passenger version of the vertical ship.

FIG. 9 is a plan view of a cargo version of the vertical watercraft.

DETAILED DESCRIPTION OF THE INVENTION

Figure 1:
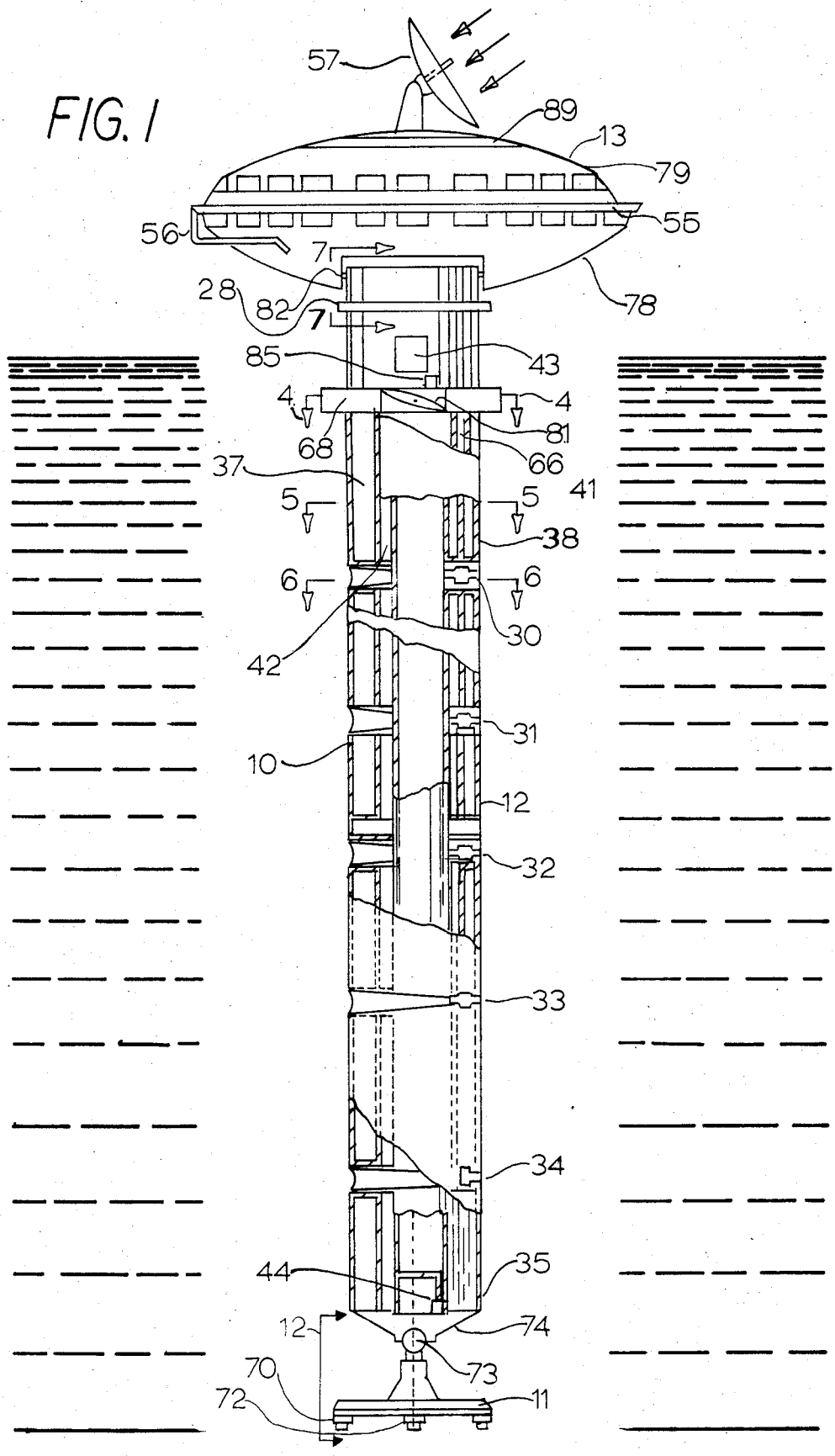
FIG. 1 is a side elevational, partial cross-sectional view of the present vertical watercraft.
Figure 2:
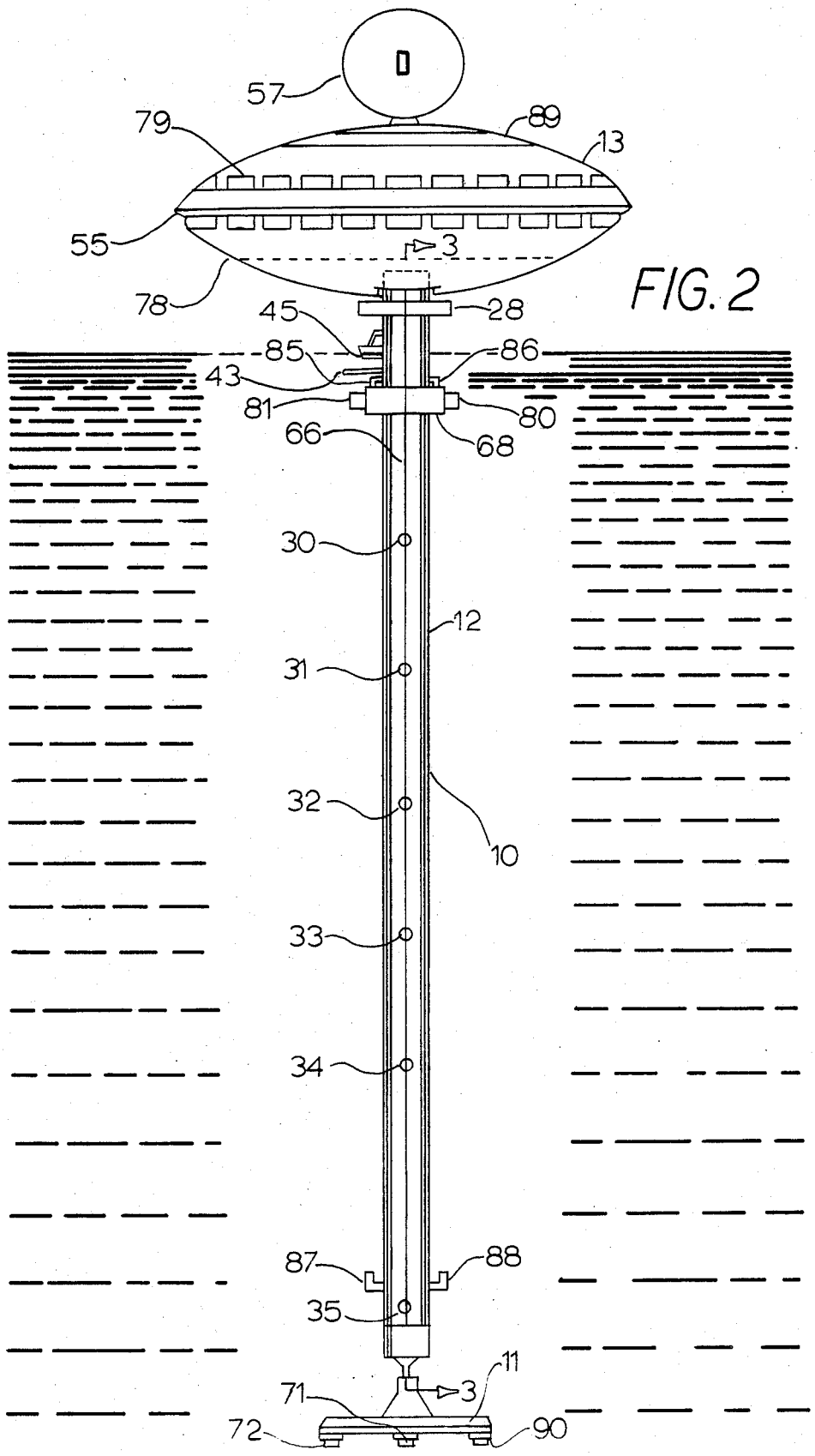
FIG. 2 is a rear view of the vertical craft, including the pilot house.

Referring now in detail to the drawings, reference numeral 10 in FIGS. 1 and 2 designates a vertical water craft embodying the invention, the same being illustrated by way of example in the form of a large water craft for transportation, across large bodies of water, of many passengers. It is to be understood, however, that the principles of the invention can be applied as well to smaller vertical water crafts. The vertical water craft 10 comprises, generally, an anchoring plate 11, a streamlined hull 12 extending vertically upwardly from the center of said anchoring plate 11, and a superstructure 13 centrally supported and articulated at the upper end of said hull by an axle 82.

As illustrated in FIGS. 1 and 2, the hull 12 is of such buoyancy, and so ballasted and controlled, that the superstructure 13 will always be above the reach of the waves. Said superstructure is detachable, for security purposes, i.e., for use as a safety boat in the event of a disaster in which the vertical assembly is destroyed.

Figure 12:
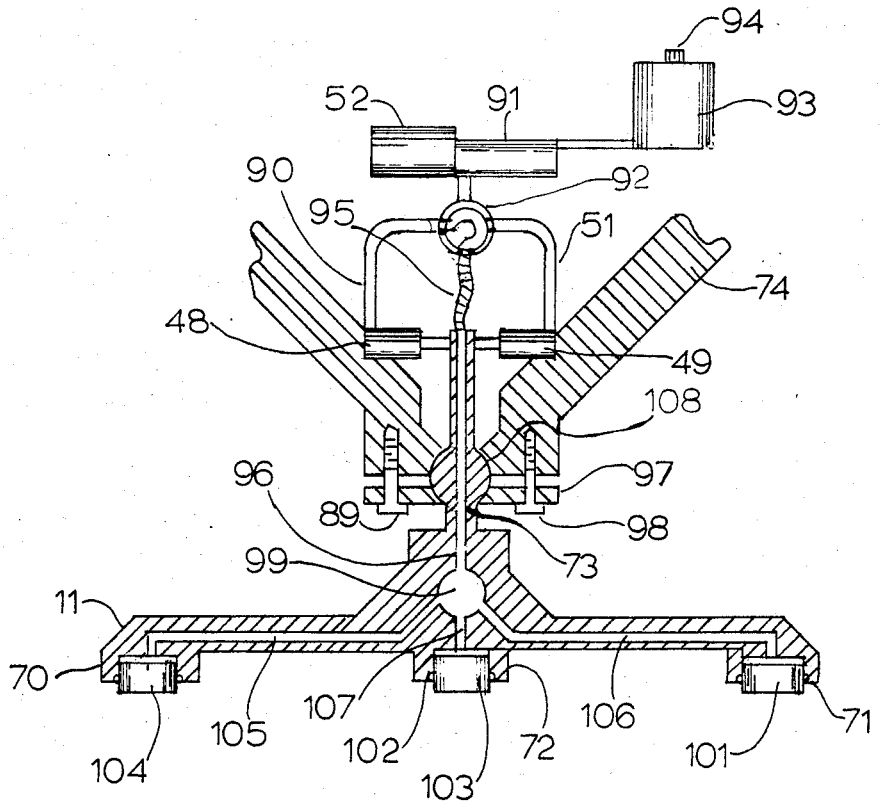
FIG. 12 is an enlarged vertical cross-section view taken along Line 12—12 of FIG. 1.

Although said water craft can be used without said anchoring plate 11, it will be understood that more stability, security and convenience will be obtained with it. As illustrated in FIGS. 1, 2 and 12, said anchoring plate 11 is centrally articulated on the hull 12 through an articulated joint 73 centrally affixed on the hull bottom 74, said joint 73 allowing control of the horizontal level of said anchoring plate 11 through the action of hydraulic means 48 and 49. The anchoring plate has four retractable hydraulic legs 101 to 104, peripherically spaced on the edge of said anchoring plate 11 to provide a safe anchoring on the sea bottom. Said hydraulic legs are used to contact and fit hard materials as rocks, stones and corals found on the sea floor, said anchoring being worked out through ballasting of the hull down to the sea floor.

As illustrated in FIGS. 1 and 2, a rain recovery system comprises a circular gutter 55 on which is fitted a drain hose 56 to be connected to a fresh water tank for accumulation of rain water. Also, the superstructure comprises a bowl-shaped underside 78, and an inverted bowl-shaped upperside 79 providing an aerodynamic superstructure having minimum air drag. On the top of said superstructure 13 is affixed a solar collector 57. As any alternate solar collector, multi-panels can be installed to form the roof of the superstructure.

As illustrated in FIGS. 1 and 2, a buoyant annular tank 28, sliding vertically on hull 12 between the superstructure 13 and the surface of the water, follows the top of the waves and recovers wave energy through suitable reciprocation means.

Figure 4:
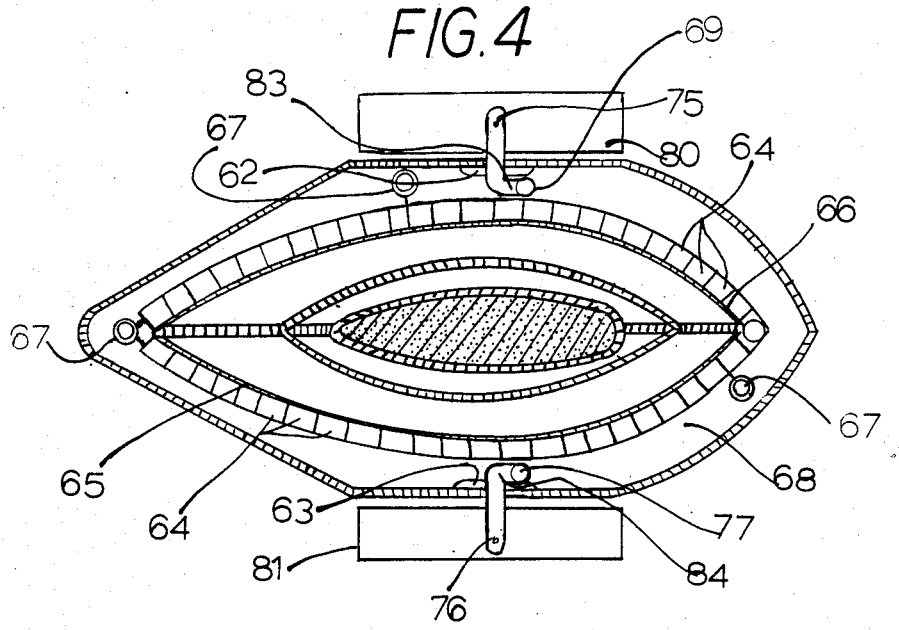
FIG. 4 is an enlargement, in cross-section, taken along Lines 4—4 of FIG. 1.
Figure 5:
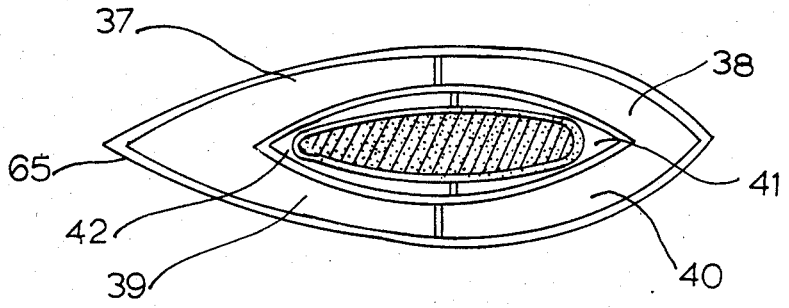
FIG. 5 is a cross-sectional view taken along Line 5—5 of FIG. 1.
Figure 6:
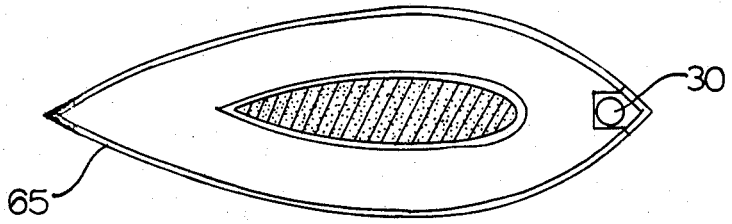
FIG. 6 is a cross-sectional view taken along Line 6—6 of FIG. 1.

As illustrated in FIGS. 4, 5 and 6, the hull is highly streamlined in order to pose the minimum drag possible.

Figure 3:
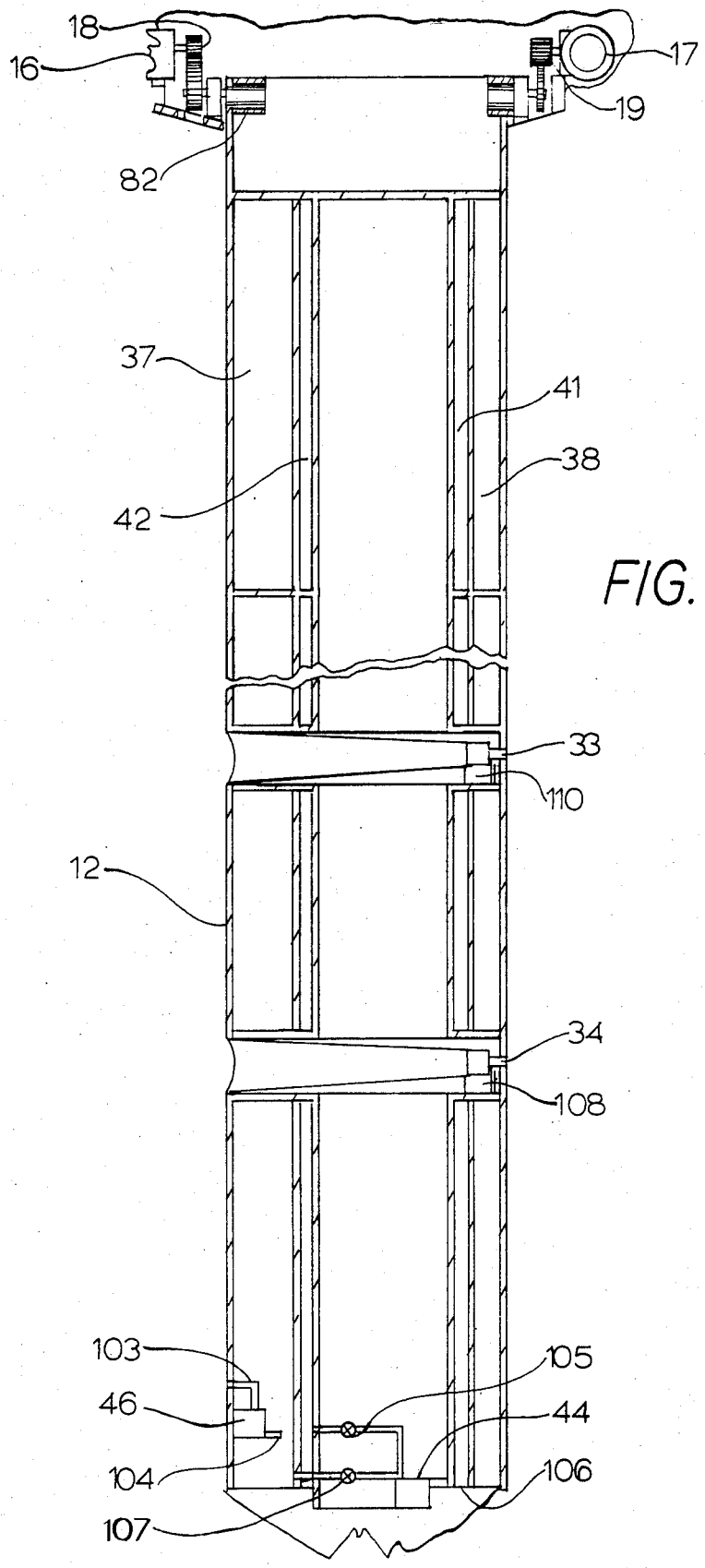
FIG. 3 is a vertical cross-sectional view taken along the Line 3—3 of FIG. 2.

As illustrated in FIGS. 3 and 7, the articulated superstructure 13 is level-adjusted through the use of electric motors 16 and 17, and reduction gears 18 and 19, but can be adjusted through the use of hydraulic means. The anchoring plate system described on FIG. 12 is an example.

An automatic level control of the superstructure can be achieved through the use of a simple pendulum apparatus.

As illustrated by example in FIGS. 1, 3 and 5, ballast compartments 37 to 42 are interconnected through pumps such as 44 and 46 which transfer liquid from one tank to the other, and in and out, to obtain the correction needed by the hull 12 in regard to the horizontal level as well as the correction of total buoyancy.

The operation of the vertical ship is the following: As seen in FIG. 5, the buoyancy is adjusted through ballasting by the volume of sea water admitted into the ballast tanks 37 to 42. Such adjustments correct the lay of the vertical ship on the surface of the water, or deep in the water, with all possible levels in between. The geometric location of the above-mentioned ballast tanks allows a fine adjustment of the tilt position of the vertical ship relative to the surface of the water.

The propulsion and steering of the vertical ship is provided in a classic way, that is, by orientable propellers. However, a preferred embodiment of the steering and propulsion mechanism is shown in FIG. 3 where pumps 33 and 34, actuated by motors 108 and 110, are orientable to provide the necessary steering and propulsion.

It is to be emphasized that the vertical ship can be powered using the thermocline power of the ocean by taking advantage of the very deep hull design of the vertical ship. See, for example, my U.S. Pat. No. 4,286,434 which describes such a concept of ocean thermal energy conversion.

The individually variable speed of motors 108 and 110 provide the necessary speed control and tilt adjustment. For transferring the sea water from one ballast tank to another, for example, from tank 42 to tank 41, a water pump 44 is used and the sea water is controlled by the cock 105; the cock 107 controlling the sea water passing from tank 37 to tank 41, or inversely. Equally, the pump 46 controls the amount of sea water leaving or entering the ballast tank 37 through pipes 103 and 104.

To anchor the vertical ship, the ballast tanks are pumped out to raise the vertical ship over the chosen anchoring place. The vertical ship is steered up over it, then lowered until the anchor plate 11 touches it; then the anchor plate 11 (see FIG. 12) is adjusted to fit the sea floor angle through the action of hydraulic pump 91, which is put into action by motor 52 and fed up by hydraulic fluid tank 93 having a filling plug 94. A cock 92 allows, for example, the hydraulic fluid to push into the cylinder 49 or 48 according to the needed angle; then the hydraulic lifts 101, 102, 103, 104 receive the pressure of the hydraulic pump 91 through cock 92, flexible hose 95, articulated by joint 73, secured by plate 97 and bolts 98 and 89. Thereunder, through conduit 96 to the pressure equalizing chamber 99 and to each hydraulic lift 101, 102, 103 and 104, through conduit 105, 106 and 107, which provide an even setting of the anchoring plate which is set firmly on the sea floor providing the stability of the vertical ship on its anchor plate 11. Thereafter, to increase the anchoring stability, the ballast tanks are filled up with the necessary quantity of sea water to obtain more weight on the anchoring plate. The reverse procedure is used to disanchor the ship.

As shown in FIGS. 2 and 6, locks 30 to 35 are secured in front of the hull of the vertical ship to take the sea water, for propulsion and steering purposes, from one side or another, or both.

Figure 11:
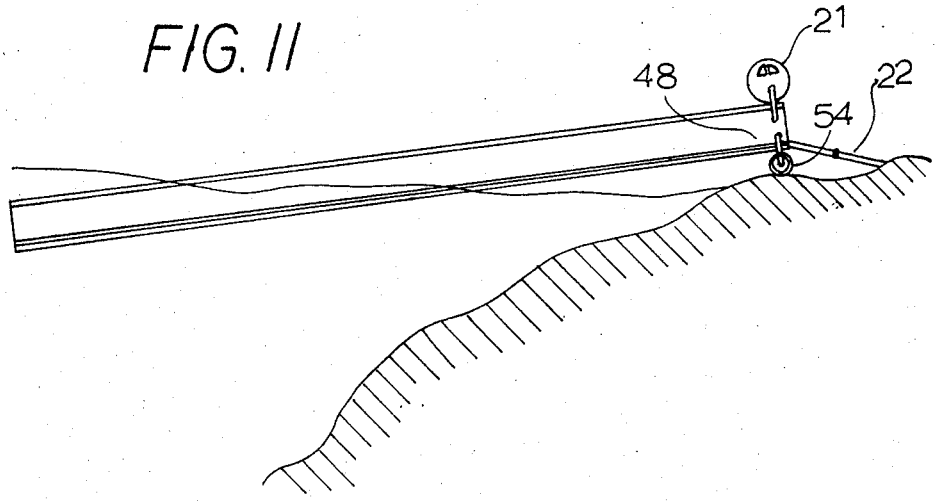
FIG. 11 is a schematic view of the cargo version of the watercraft after it has landed ashore.

As shown in FIGS. 9 and 11, the cargo version of the vertical ship is equipped with powered landing gears 54 and 23, put into action by motors 53 and 58 and supported by brackets 59 and 60 affixed to the hull 12, steerable through hydraulic booms 47 and 48, and a foldable hatch 22 which is used as an access ramp for the passage of loading and unloading the trucks and forklifts.

A pilot control house 21 is articulated horizontally on bearings 24 and 25, on brackets 20 secured to the hull 12.

The landing operation is the following: as shown in FIG. 11, the vertical ship ballast tanks are emptied to the point that the vertical ship lays on the water surface with a small angle to the horizon, then is steered toward the shore until the landing gears can roll over the ground. Then the maneuver is made through the landing gears which are powered and steerable to allow fine setting of the landing hatch ramp 22. The reverse procedure is used to sail away.

The cargo version of the vertical ship can be used for sea floor works. In that case, the bottom of the hull is open to sea water and contains a volume of air trapped inside the hull walls allowing the workers to have their upper bodies in breathable, pressurized air, and their feet into the water and on the sea floor. For such work the bottom portion of the hull 12 will be preferably articulated in regard to the hull 12 to stay horizontal and as close as possible to the sea floor regardless what the tilt of the hull 12 might be, the closeness of the articulated portion of the hull allowing more air, and less water, in for the workers. This portion of the hull may telescope onto an upper portion of the hull when not in use, to shorten the hull.

With reference to FIGS. 1, 2 and 4, an annular wiper tank 68 having rollers 64 is juxtaposed in contact with the exterior wall 65 of the hull 12 of said vertical water craft. The wipers roll over the surface of the exterior walls 66 and are supported axially by brackets 67 which are affixed to the annular tank 68 which has bearings 62 and 63 into which two axles 75 and 76 are rotatingly affixed to the vertical rudders 80 and 81, and have the other end in the form of pedals 83 and 84, which are equipped with water seals 69 and 77 on top, and are moved down, by the vertical rods 85 and 86, and up by the air-injectors 87 and 88. The up and down motion moves the vertical rudders 80 and 81 to an appropriate angle to have (1) a moving action up and down when the vertical water craft is traveling or (2) propulsive action provided by the vertical travel of said annular wiper tank 68 through buoyancy variation. The annular tank wiper 68 has four apertures located, two at the top, corresponding at the position of the rods 85 and 86, and two at the bottom corresponding to the position of the air-injectors 87 and 88. The two rods 85 and 86 have a smaller diameter than the corresponding apertures situated in the top of said annular wiper tank 68. They allow trapped air inside the tank-wiper to escape.

The operation of said wiper system is the following: When the annular wiper-tank 68 moves up and the vertical water craft is traveling, the rudders 80 and 81 are oriented to provide a lifting action to the tank which already has the lifting action of its buoyancy. When the annular wiper-tank 68 reaches the top of the hull, the two rods 85 and 86 push the two pedals 83 and 84 down, by pushing on the two seals 69 and 97, thus moving the rudders into the opposite position and leaving the seals 69 and 77 open, thus allowing the sea water to fill up the tank by allowing the air to escape through the openings encircling the two rods 85 and 86 shown in FIGS. 1 and 2.

When said annular tank-wiper 68 reaches the bottom of the hull by gravity and rudder action, the two air-injectors 87 and 88 are opened by the tank 68 and the two pedals 83 and 84 are moved up, moving the rudders into an opposite position and closing the pedals seals 69 and 77. Consequently, the injected air fills up the annular tank 68, pushing the water out through the bottom apertures situated around the air-injectors 87 and 88. Said two apertures have a diameter larger than the diameter of the air-injectors 87 and 88 to let the water escape through said apertures.

When said annular tank-wiper 68 is air-filled, it goes up by means of increased buoyancy, as well as by lifting action of its vertical rudders. The annular tank-wiper 68 rolls on its rollers 64 which keeps the hull clean by crushing sea organisims, as the up and down cycle is repeated automatically.

It is emphasized that said annular tank-wiper 68 may be advantageously constructed with at least two alternate rows of rollers 64, one over the other, and in offsetting fashion providing a smoother ride of said annular tank-wiper 68 over the surface of the hull.

It is emphasized that said annular tank-wiper 68 can be equipped with porous rollers 64 which can be filled with product such as fish oil, chemical or mineral oil to help protect said hull 12 from corrosion or sea organ growth.

It is also emphasized that a scraper blade may be mounted on each roller to keep the rollers clean.

As shown in FIG. 8, at the hull 12 is affixed at least one fin 14 to offset any accidental vertical lift caused by the waves on the vertical water craft hull, said fins providing more vertical stability by increasing the vertical period of said vertical ship. Although the vertical ship has a buoyancy of one at wave level, it is normally not affected by the lifting power of the waves. Automatic buoyancy control can be effected through the use of suitable depth sensors for controlling the action of the water pump of the ballast tanks.

As illustrated in FIGS. 8 and 11, said vertical water craft 10 can have its hull tilted to the horizontal level for landing procedures or servicing of the hull or anchor plate through appropriate ballasting.

Figure 10:
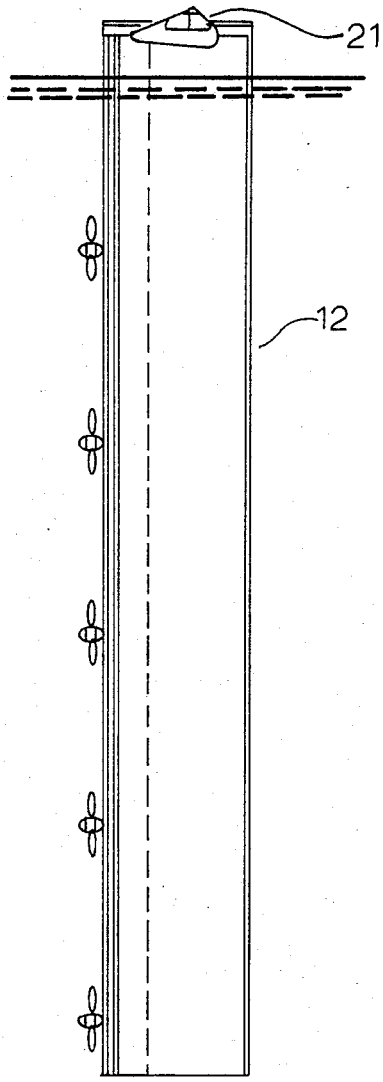
FIG. 10 is a perspective view of the cargo version of the vertical ship and pilot house taken from a deep water perspective.

FIGS. 9, 10 and 11 illustrate a vertical cargo water craft. As illustrated in FIGS. 9, 10 and 11, the superstructure 21 is much smaller in size than the one for passengers and is articulated at the axle bearings 24 and 25 in order to be horizontally and automatically leveled for any tilted positions of said vertical hull 12, because of the greater weight of the bottom of said superstructure. Said hull 12 is closed by a hatch 22 which can be used as an access ramp for loading and unloading directly from land by rolling the hull on wheels 23 and 54.

In the passenger embodiment, a very large pilot house 89 is set at the top of the superstructure 13 and has an unobstructed circular view all around the vertical water craft (See FIG. 1), and is set atop of a larger passenger lounge and cabin having a circular view.

The shuttle boat 45 shown in FIG. 2 operates as follows: In the vertical water craft 12, the draw-bridge door 43 is opened and the vertical water craft is lowered until the level of water into the shuttle compartment is high enough for the shuttle boat 45 to enter it. Then said draw-bridge door 43 is closed and the vertical water craft is raised at the correct level, allowing the water into the shuttle compartment to return to the sea by gravity. Said shuttle boat is then supported by its cradle. When the shuttle boat is to depart from the vertical water craft, the hull 12 is lowered to a level necessary to float said shuttle boat 45; then said draw-bridge door 43 is open and the shuttle boat is ready to sail.

It is to be understood that while there have been shown and described the preferred embodiments of the present invention, the invention may be embodied otherwise that is herein specifically illustrated or described and that in such embodiments certain changes in the detail of construction, or in the form and arrangement of the parts, may be made without departing from the underlying idea or principles of this invention within the scope of the appended claims.

Having thus described my invention what I claim as new, useful and non-obvious and, accordingly, secure by Letters Patent of the United States is:

1. A vertical watercraft for stable transport in rough seas, comprising:

a. a normally above-waves, personnel-carrying first portion;

b. a normally vertically-disposed, elongate, knife-blade-shaped hull second portion, normally substantially submarine in operation and having a hydrodynamically streamlined configuration with generally narrow leading end trailing edges for reduced drag when propelled with said leading edge forward in its normal vertical orientation for transport;

c. articulated connection means connecting said first portion to said second portion for maintaining said first portion level when said second portion is changed from its normally vertical orientation for certain operations, said operations including passage through shallow waters, landing, and loading;

d. adjustable ballast means disposed within said second portion to maintain said first portion above water and to regulate trim, attitude and bottom clearance of said second portion under different loads and operating conditions;

e. a plurality of propulsion means, vertically spaced-apart within said second portion said propulsion means being so disposed relative to the center of drag of said second portion as to permit control of the vertical angle of said second portion while under way by regulation of the relative power to each of said propulsion means.

2. The watercraft of claim 1, said first portion being detachable from said second portion, and said first portion being sufficiently water tight and buoyant to serve as an independent vessel in emergencies.

3. The watercraft of claim 1, including machinery, said machinery being disposed within said second portion, substantially below the center of gravity of said second portion.

4. The watercraft of claim 1, said ballast means including means for bringing said second portion from a vertical to a relatively horizontal position for shallow water entry and loading.

5. The watercraft of claim 4, including landing wheel means attached to the exterior of said second portion adjacent said connection means for enhanced landing operations.

6. The watercraft of claim 1, including anchor plate means attached to the exterior of said second portion at the end remote from said articulated connection means for selectively securing the lower end of said hull to the sea floor.

7. The invention of claim 1, in which the center of gravity is disposed within the one-third of said hull most remote from said connection means for enhanced stability and resistance to damage from collisions.

8. The watercraft of claim 1, including solar energy collecting means attached to the uppermost portion of said first portion for collecting solar energy to power operations.

9. The watercraft of claim 1, including cargo channel means longitudinally disposed within said second portion for holding cargo to be transported.

10. The watercraft of claim 9, further including deployable ramp means connected to the upper portion of said second portion said ramp means including watertight hatch means for sealing said ramp means within said hull during normal travel, said ramp means deployable to provide a loading and unloading ramp from a landing area ashore to said cargo channel means for easy loading and unloading of cargo when said hatch means is open.

11. The watercraft of claim 1, including rain water collecting means connected to the upper surface of said first portion for providing potable water to personnel.

12. The watercraft of claim 1, including buoyant annular tank means sliding vertically outside said second portion connected to reciprocating means secured to said second portion said reciprocating means converting wave energy imparted to said tank means into energy useful to the operation of said watercraft.

13. The watercarft of claim 1, further comprising automatic hull cleaning means for cleaning said second portion while under way, said cleaning means including annular tank means sliding vertically up and down the outer surface of said second portion moving means connected to said tank means, said moving means alternately and repetively moving said tank means from a low level on said second portion to a top level on said second portion and then from said top level to said bottom level, said moving means being powered by rudder means acting against the forward motion of said watercraft, wherein the attitude of said rudder means is reversed at each position, and roller means connected to said tank means and disposed against the outer surface of said second portion to crush marine life.

14. The watercraft of 13 including powering said moving means with compressed air.

15. The watercraft of claim 13, including scraper blade means engaging said roller means for scraping debris off said roller means.

16. The watercraft of claim 1, said ballast means including tank, seawater pumps and valves for pumping seawater in and out of selected tanks to adjust buoyancy, trim and tilt.

17. The watercraft of claim 1, further comprising means for converting the difference in temperature between different ocean depths into useful power for operating said watercraft, the upper end of said second portion transferring thermal energy at a high temperature and the lower end of said second portion transferring thermal energy at a lower temperature when said second portion is in its normal, vertical orientation.

18. The watercraft of claim 1, said propulsion means including means for intaking seawater at said leading edge and means for expelling seawater at said trailing edge for more efficient propulsion.

19. The watercraft of claim 1, said propulsion means further including adjustable deflecting means for steering said watercraft.

20. The watercraft of claim 1 including horizontal fin means attached to the exterior surface of said second portion for reducing velocity of vertical motion.

21. The watercraft of claim 1, in which said second portion includes means for telescoping thereof into a smaller longitudinal length.

22. The watercraft of claim 1, further comprising shuttle craft docking means in the upper portion of said second portion.

* * * * *